United States Patent [19]

Velasquez

[11] Patent Number: 4,817,946

[45] Date of Patent: Apr. 4, 1989

[54] YIELDABLE BASEBALL BASE

[76] Inventor: Florencio Velasquez, 258 Frederick St., Nogales, Ariz. 85621

[21] Appl. No.: 43,352

[22] Filed: Apr. 28, 1987

Related U.S. Application Data

[63] Continuation-in-part of Ser. No. 798,935, Nov. 18, 1985, abandoned.

[51] Int. Cl.[4] ..... A63B 71/00
[52] U.S. Cl. ..... 273/25
[58] Field of Search ..... 273/25

[56] References Cited

U.S. PATENT DOCUMENTS 2,298,689 10/1942 Ferris ..... 273/25
3,204,958 9/1965 Velasquez ..... 273/25

*Primary Examiner*—Richard C. Pinkham
*Assistant Examiner*—T. Brown
*Attorney, Agent, or Firm*—Fleit, Jacobson, Cohn & Price

[57] ABSTRACT

A yieldable baseball base construction with improved mounting assembly for baseball, softball, and other ball games. The mounting assembly includes cooperating male and female members; two guiding rods fixed in a base frame carry the male member. Springs mounted on the guiding rods allow the male member to deflect relative to the female member which is anchored in the ground

7 Claims, 1 Drawing Sheet

YIELDABLE BASEBALL BASE

This application is a continuation-in-part of U.S. Ser. No. 798,935, filed Nov. 18, 1985 (now abandoned).

BACKGROUND OF THE INVENTION

This invention relates to an improved baseball base construction and more particularly to the mounting and anchoring of a base used for baseball, softball or other ball games.

In playing these games it is very important to avoid injury to the players when they are "sliding into the base."

The yieldable bases are designed to accept a limited lateral movement to minimize physical damage to players.

U.S. Pat. No. 1,244,044 describes a baseball base having an anchor with a socket in which a pin or stem, attached to the base, is carried. The base is provided with a plate secured upon the bottom thereof having a downwardly projecting lug to which a coil spring is secured. The spring permits limited lateral movement of the base when the base is violently struck or pressed by a player.

U.S. Pat. No. 2,947,540 relates to anchoring means to secure a base sack in position. The sack is tied by straps which are affixed to the side walls of the sack and extend about loops projecting upwardly from top plate. The plate is tensioned for limited sliding movement by means of a plurality of radially arranged contractive springs connecting the plate with the frame.

The anchoring means permit the movement of the sack in any direction through the plane of the base and retain the sack at the proper location. The sack has limited movement with the impact of player thereagainst.

U.S. Pat. No. 3,204,958 (Velasquez) discloses removable mounting and yieldable anchoring of a baseball base at the three field positions.

The anchor assembly has a socket member which receives a vertically elongated stem of a removable support assembly. The stem supports the pad assembly in a space adjacently above the surface of the ground. A bearing plate is secured as by welding to the upper end of the stem and a spring anchor flange which extends from two sides of the stem and anchors two pairs of springs to the mounting assembly. The latter is slidably movable relative to the bearing plate in two perpendicular directions defined by the intersecting parallel grooves. The pad assembly is displaceable in two perpendicular directions from the central position to which it is biased by the springs.

Accordingly, a runner approaching a base from either of two directions will cause displacement of the base upon impact against the bias of the springs after which the pad assembly returns to its original position. The two directions in which the assembly is displaceable will depend upon the angular orientation of the supporting assembly.

Although the prior art base construction described in U.S. Pat. No. 3,204,958 significantly reduces any likelihood of injury to the players, it has a number of technical and economical disadvantages; it is rather complicated and expensive to manufacture.

SUMMARY OF THE INVENTION

The present invention comprises a yieldable baseball base having an improved assembly which is capable of slight lateral movement and will promptly return the base to its proper position. The assembly includes male and female members, guiding members positioned parallel to the horizontal axis of the base and pass through the body of the male member. Spring members are mounted around a portion of the guiding members between the male member and the base to enable the self-restoring movement.

Thus, it is an object of the present invention to provide an improved base construction which will enhance the utility and safety associated with playing the game of baseball, softball or the like by people of any age and sex.

Another object of this invention is to provide a base construction that will endure a great amount of wear and punishment and is yieldable in the directions in which impact is applied by the player.

A further object of the present invention is to provide a base construction which is economical to manufacture.

Still a further object of the present invention is to provide base construction which is easy to assemble and may be readily cleaned to remove sand, dirt or other foreign matter.

These and other objects, features and advantages of the present invention will be set forth in the detailed description taken in connection with the accompanying drawings.

DESCRIPTION OF THE PREFERRED EMBODIMENT

Figure 1:
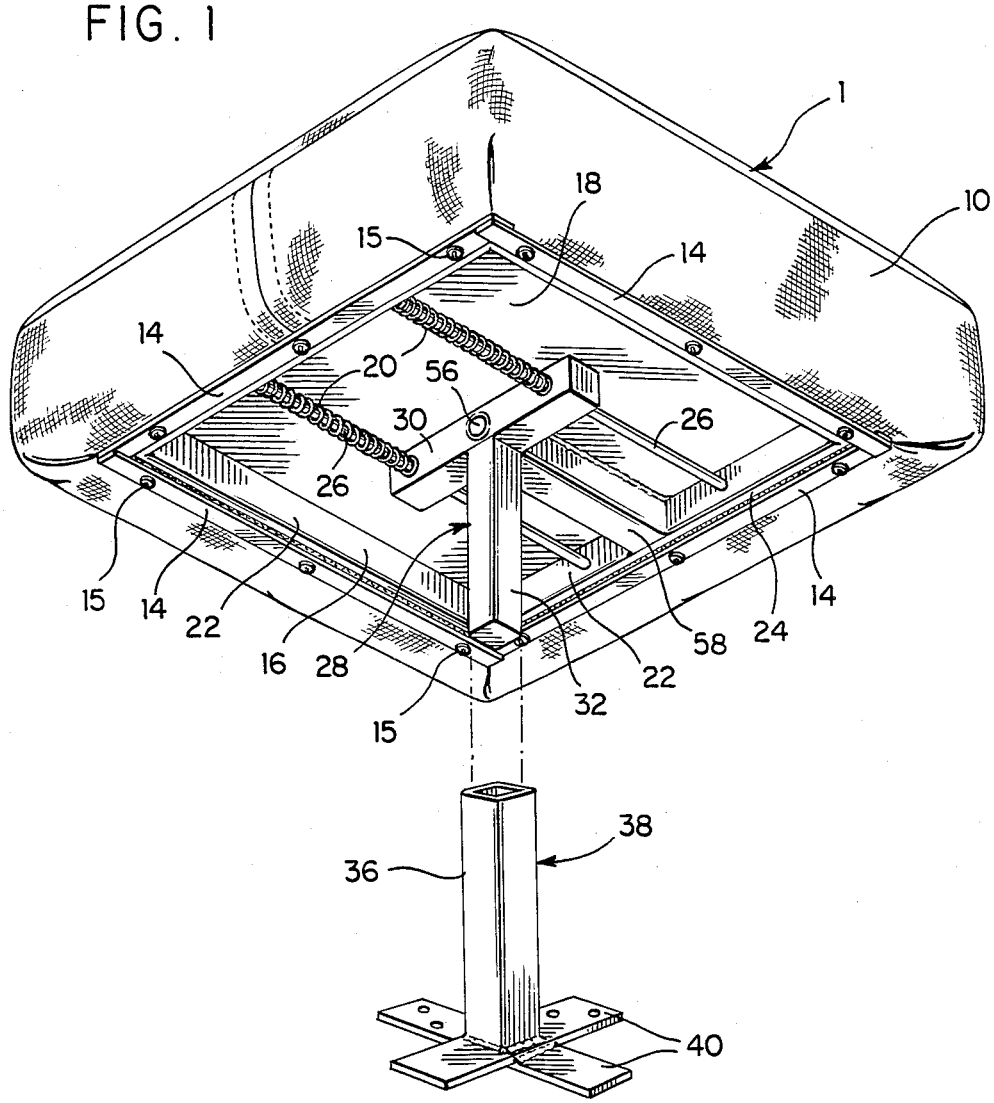
FIG. 1 is a perspective view of the novel yieldable base shown partly exploded.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation. Referring now to the drawings wherein the same numerals refer to like and corresponding parts in the two views, the preferred embodiment of the invention is portrayed in FIGS. 1 and 2 and comprises a base or sack generally designated as 1.

The base 1 is generally square in shape and has a covering 10 filled with relatively thick soft resilient material 12. The resilient material may be foam rubber, vinyl, urethane or other like material. The covering is tied or secured to the frame 16 of the base by strips 14 which are secured by screws 15, but may be secured by rivets or other means.

The covering material is determined by league rules; usually, it is a hard type of material, for example, canvas, nylon, rubber, etc. When the rules require shoes with rubber spikes then canvas may be used for the covering material. If shoes with metal spikes are required, then a strong nylon or rubber covering is preferred. The size of a bag depends on the official rules for the size of the base. Most of the bags are 15" square and about 3" thick.

The bases are positioned in such a way that springs 20 face a runner. When the runner tags a base, he hits or strikes its edge. As a result of the strike the springs 20 are compressed, displacing the base 1 about 2"–2¾" from its normal or rest position.

It will be appreciated that when such pressure is removed the base will promptly return to its original position.

The frame 16 is a recessed square plate to define a recessed or sunken main plate 18 surrounded by normally vertically extending walls 22 on all four sides which each terminate in an edge flange 24 normally extending from the edge of wall 22 remote from the main plate 18 and extending parallel with main plate 18. A pair of guide rods 26 ar fixed to opposite walls 22 by welding or otherwise and extend parallel to one another in a spaced relationship and parallel to and spaced from main plate 18. A male anchor member 28 suitably provided with holes is slidingly carried on the guide rods 26. Male anchor member 28 consists of a T shaped bar square in cross section with the top cross element 30 of member 28 provided with the holes and carried by the guide rods 26. A guide pin 56 is welded to end of element 30 and projects parallel to and in between the two guide rods 26. The pin 56 is telescopically received in a sleeve 58 welded to main plate 18 and to wall 22. The vertical depending leg element 32 of member 28 cooperates with a female anchor member 36 consisting of a square cross section tube 38 open at the top to receive the leg element 32 in a sliding, nonrotatable manner and two crossed plates 40 welded together and to the bottom of tube 38. Both tube 38 and depending element 32 are non-circular in cross section to resist lateral movements.

Springs 20 are mounted on the guide rods 26 and bear against the top cross element 30 at one end and a wall 22 at their other ends and bias the cross element 30 relative to the frame 16.

The frame 16 is fitted with a protective core member 44 consisting of a circular cross section firm resilient core 46 covered by a cloth 48 or like material. The core member is sized to fit against the outside of walls 22 and be supported by the edge flanges 24. The filling or padding 12 completely fills the interior space of the base projecting outwardly of frame 16 and is held in place by covering 10. The edge flanges 24 are provided with a series of tapped holes. Securing strips 14 of the same length as the edge flanges are provided with matching holes. The edges of the covering 10 are drawn around the base and brought between strips 14 and edge flanges 24 where they are secured or sandwiched by means of screws 15 which firmly secure the strips 14 to the edge flanges 24 with the edges of covering 10 caught between them.

Figure 2:
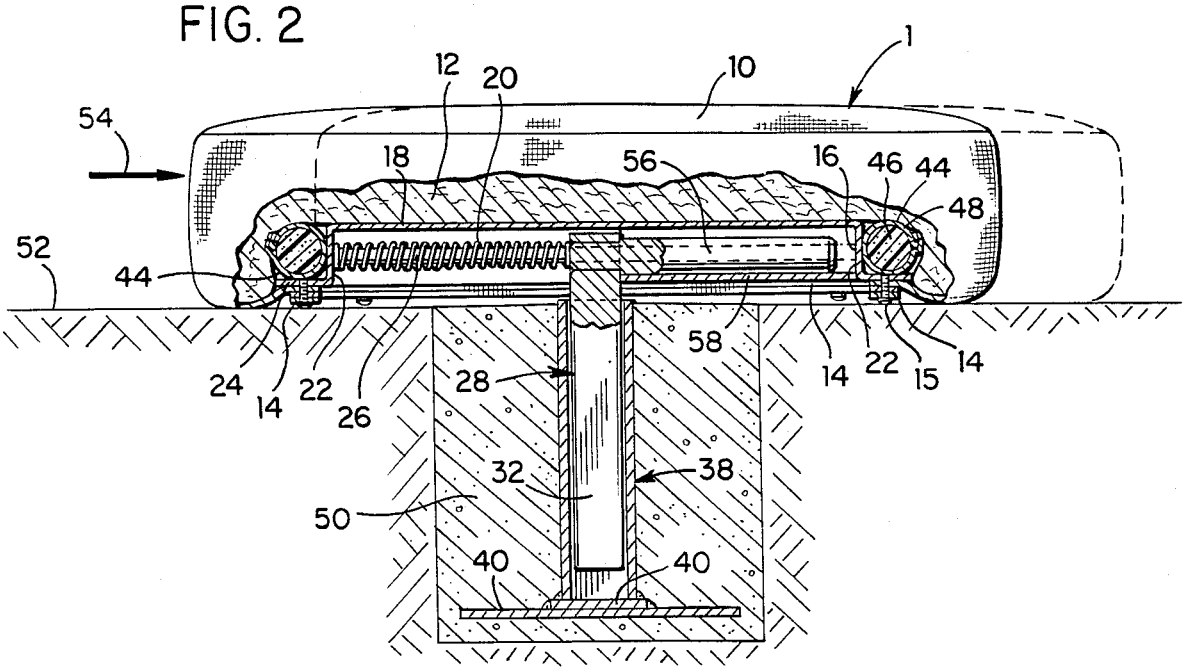
FIG. 2 is a side view of the base partly in section showing the base mounted in the ground.

As shown in FIG. 2, the female anchor member 36 is set in concrete 50 in the ground 52 with the open top of tube 38 at or near ground level. The base is set into position by inserting the vertical leg element 32 into the tube 38 with spring 20 lying on the side of the base facing the runner. When a runner strikes the base 1 as indicated by the arrow 54, the base 1 will deflect to the right as seen in FIG. 2 to the position shown in dotted lines. This deflection compresses springs 20 which restores the base to the solid line position when pressure is taken off the base.

Although a single embodiment of the invention has been disclosed and described herein, it is obvious that many changes may be made in the size, shape, arrangements and detail of the various elements of the invention without departing from the scope of the novel concepts of the present invention.

What is claimed is:

1. A base comprising a frame in the form of a plate with bent up side walls with side edge flanges projecting outwardly from the side walls, guide means extending across the frame fixed to opposed side walls, anchor means including a non-circular tube open at one end for embedding in the ground to resist any movement with the open end located near ground level and exposed, carriage means slidingly mounted on the guide means and including a depending stem having a peripheral shape to match the inner shape of the non-circular tube so that the stem can be slidingly received in the non-circular tube, spring means biasing said carriage means relative to the frame, padded means for covering the frame including a roll that surrounds the frame and lies at the juncture of the side walls and the side edge flanges, and attaching means for attaching the padded means to the frame.

2. A base as in claim 1 wherein the guide means are a pair of parallel rods.

3. A base as in claim 2 wherein the carriage means includes a bar with spaced holes through which the pair of parallel rods are received.

4. A base as in claim 3 wherein the spring means includes a pair of springs received on the pair of parallel rods.

5. A base as in claim 1 wherein the anchor means has a square tube.

6. A base as in claim 5 wherein the depending stem is square in cross section.

7. A base as in claim 1 wherein the padded means includes padding surrounding the frame and a cover enclosing the padding which is attached to the frame.

* * * * *